US007140167B2

(12) United States Patent
Countz

(10) Patent No.: US 7,140,167 B2
(45) Date of Patent: Nov. 28, 2006

(54) POSITIVE PRESSURE FRESH MEAT PACKAGING SYSTEM

(75) Inventor: John W. Countz, Wichita, KS (US)

(73) Assignee: Cargill, Incorporated, Wayzata, MN (US)

( * ) Notice: Subject to any disclaimer, the term of this patent is extended or adjusted under 35 U.S.C. 154(b) by 74 days.

(21) Appl. No.: 10/642,359

(22) Filed: Aug. 15, 2003

(65) Prior Publication Data

US 2004/0144063 A1 Jul. 29, 2004

Related U.S. Application Data

(60) Provisional application No. 60/443,044, filed on Jan. 28, 2003.

(51) Int. Cl.
*B65B 31/00* (2006.01)

(52) U.S. Cl. ..... 53/510; 53/434; 53/512

(58) Field of Classification Search ..... 53/526, 53/510, 527, 528, 127, 79, 84, 86, 106, 108, 53/434, 512

See application file for complete search history.

(56) References Cited

U.S. PATENT DOCUMENTS

| | | | | |
|---|---|---|---|---|
| 2,496,609 | A * | 2/1950 | Antwerpen | 53/122 |
| 2,780,043 | A | 2/1957 | Hensgen | |
| 3,516,217 | A | 6/1970 | Gildersleeve | |
| 3,686,822 | A | 8/1972 | Woldfelsperger | |
| 3,693,314 | A * | 9/1972 | Reid et al. | 53/417 |
| 3,832,824 | A * | 9/1974 | Burrell | 53/417 |
| 3,914,917 | A * | 10/1975 | Young | 53/434 |
| 4,164,111 | A * | 8/1979 | Di Bernardo | 53/434 |
| 4,182,095 | A * | 1/1980 | Day | 53/86 |
| 4,457,122 | A * | 7/1984 | Atkins et al. | 53/434 |
| 4,633,654 | A | 1/1987 | Sato et al. | |
| 4,709,818 | A | 12/1987 | Spinosa et al. | |
| 4,744,204 | A | 5/1988 | Schlegel | |
| 4,964,259 | A | 10/1990 | Ylvisaker et al. | |
| 5,056,292 | A * | 10/1991 | Natterer | 53/86 |
| 5,170,609 | A | 12/1992 | Bullock et al. | |
| 5,224,324 | A | 7/1993 | Granfelt | |
| 5,323,590 | A | 6/1994 | Garwood | |
| 5,603,284 | A * | 2/1997 | Freedman | 119/28.5 |
| 5,930,983 | A | 8/1999 | Terminella et al. | |
| 6,094,888 | A | 8/2000 | Pazdernik et al. | |
| 6,637,177 | B1 * | 10/2003 | Trillich et al. | 53/434 |
| 2002/0043050 | A1 | 4/2002 | Costello et al. | |

FOREIGN PATENT DOCUMENTS

| | | |
|---|---|---|
| DE | 295 00 637.4 | 2/1995 |
| DE | 295 00 637.4 | 4/1995 |
| GB | 2 113 646 A | 8/1986 |
| JP | 2003072702 | 3/2003 |

OTHER PUBLICATIONS

Copy of Notification of Transmittal of the International Preliminary Report on Patentability (8pgs).

* cited by examiner

*Primary Examiner*—Sameh H. Tawfik
(74) *Attorney, Agent, or Firm*—Dorsey & Whitney LLP

(57) ABSTRACT

A positive-pressure packaging system is provided to seal a product within an open package. The system includes a pressure chamber which encloses the product and package and is configured to expel atmosphere gases initially present within the package. The system includes a seal assembly for straitening the opening of the package so as to prevent the passage of particulate and other matter from within the open package. The system also includes a pressure source configured to increase pressure within the pressure chamber so as to expel the atmosphere gases by compression of the open package. A method of using the positive-pressure packaging system is also disclosed.

12 Claims, 2 Drawing Sheets

POSITIVE PRESSURE FRESH MEAT PACKAGING SYSTEM

CROSS-REFERENCE TO RELATED APPLICATION(S)

This application claims priority to U.S. provisional application No. 60/443,044, filed Jan. 28, 2003, which is hereby incorporated herein in its entirety.

FIELD OF THE INVENTION

The present invention relates generally to packagers. More specifically, the present invention relates to a packager and sealer for enclosing a product.

BACKGROUND OF THE INVENTION

Vacuum packagers have been used to seal a variety of products. Typical examples include stand-alone clamshell vacuum bag sealers, linear clamshell vacuum bag sealers and rotary clamshell vacuum bag sealers. Such vacuum packages generate a negative pressure within a bagged product that is inside, for example, a clamshell or platen with a dome chamber. The bag is then heat-sealed closed while under the generated vacuum.

Producing vacuum energy with conventional vacuum packagers is very expensive and evacuation of the bag-sealing chamber is very time consuming even with relatively large vacuum pumps. This leads to slower throughput capabilities per machine. In addition, vacuum packagers are currently very large and slow and are not generally cost effective for many packaging applications. Finally, the vacuum packagers generally do not efficiently compress the packaging tightly around the packaged product.

Thus, there is a need in the art for an improved packager and sealer that efficiently and securely packages various products. There is a further need for a packager adapted for sealing fresh meat products.

SUMMARY OF THE INVENTION

The present invention, according to one embodiment, is a positive-pressure packaging system. The system includes a platen for receiving a product and a packaging material having an open end and a dome moveable to a first position relative to the platen wherein the product may be placed on the platen, and a second position relative to the platen wherein the product is substantially enclosed inside of a pressure chamber defined by the platen and the dome. A seal assembly operatively couples the dome to the platen in the second position and straitens the open end. The seal assembly is adapted to allow expulsion of fluids from the pressure chamber. The system further includes a pressure source operably coupled with the dome for increasing pressure within the dome so that the packaging material is compressed against the product.

The present invention, according to another embodiment, is a method of packaging a product. The method includes providing a product in an open package on a support, enclosing the product and the package on the support within a pressure chamber, straitening an open end of the package to restrict flow of a liquid and inhibit passage of a particulate through the open end, and increasing the pressure within the pressure chamber to expel the liquid from the package and compress the open package about the product.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Figure 1:
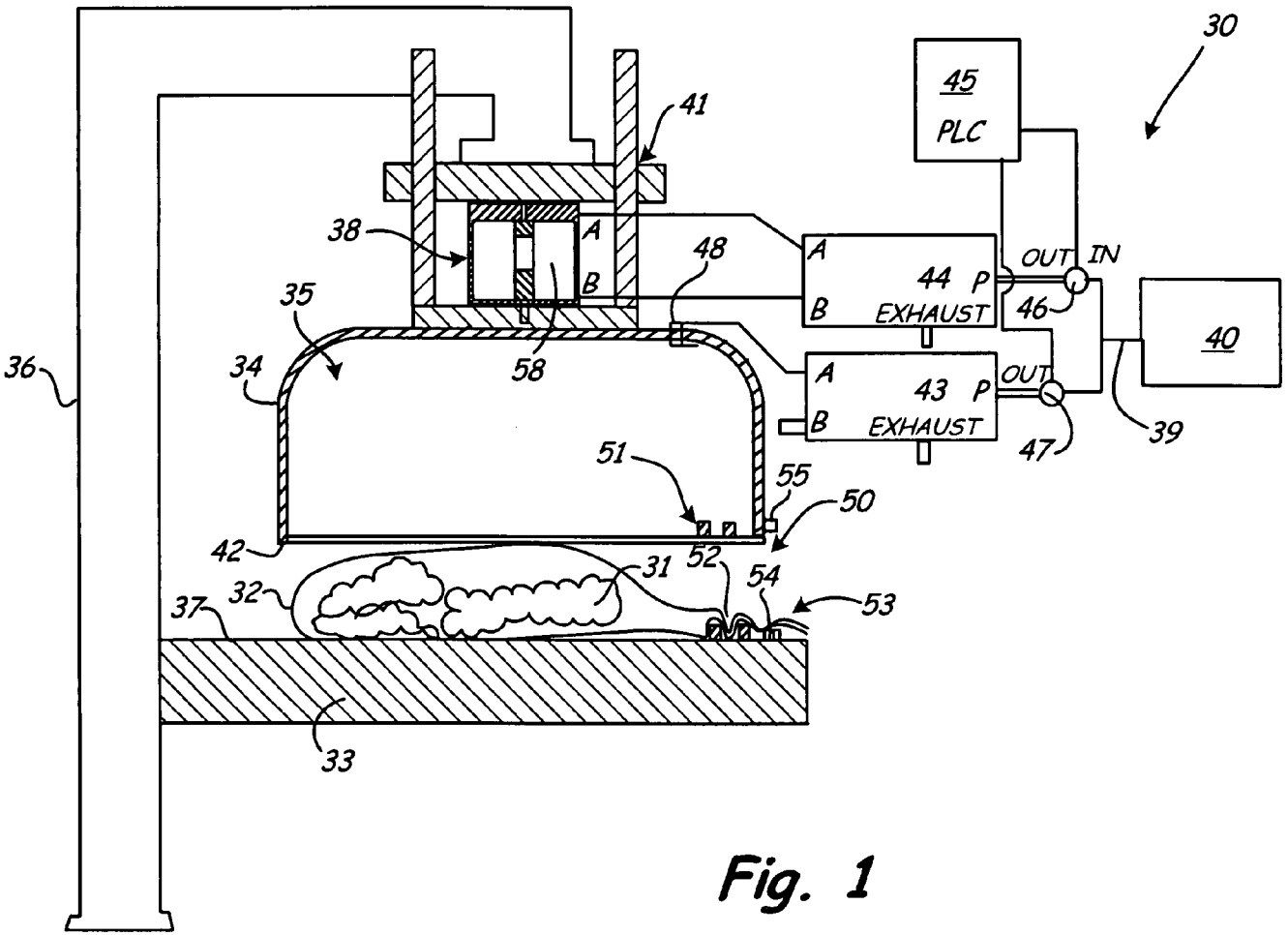
FIG. 1 is a schematic illustration of one embodiment of the packaging and sealing system in accordance with the present invention.

FIG. 1 illustrates a positive-pressure packaging system 30 for sealing a product 31 within an open package 32 including, but not limited to, a bag, a pouch, webbing, or other suitable packaging materials. The particular packaging materials can be chosen to be conducive to the sealing device and to assure a good seal. For example, the sealing device may be provided with a heat-sealing component, in which case, heat-sealable plastics may be used as the packaging material. Such a heat-sealing configuration provides an airtight, hermetic seal for the package to improve shelf life of the product therein.

The packaging system of the present invention is particularly suited for packaging consumables and perishable products including, but not limited to, meat, fish, produce, and other foodstuffs. The system and method of the present invention may also be utilized for the packaging of non-food items. The packaging system of the present invention is particularly suited to compress an open package tightly around the product in such a manner that it expels substantially all of the atmosphere or ambient air initially present within the open package.

The packaging system or packager 30 includes a packaging press having a platen 33 and a pressure dome 34. The pressure dome is configured to reciprocally seat or abut against platen 33 in order to form a pressure chamber 35 between the platen 33 and the pressure dome 34. In one embodiment, platen 33 is fixed to a stable base 36. The platen 33 need not be so fixed and may be configured to move instead of, or in addition to, the pressure dome 34 in such a manner that the platen 33 and the pressure dome 34 close together and form the pressure chamber 35. In one embodiment, the platen 33 includes a generally flat support surface 37 that is dimensioned to support the open bag 32 with the product 31 disposed therein. The smooth surface of the platen 33 facilitates an airtight seal with the dome, as discussed greater detail below.

The pressure dome 34 is sufficiently sized to receive the desired product to be packaged. The pressure dome 34 is configured to withstand internal pressures of multiple atmospheres. In one embodiment, the pressure dome 34 is machined or cast from aluminum to achieve a lightweight but structurally sufficient pressure vessel. Other materials and methods may also be utilized to provide a suitable pressure vessel shell.

An actuator 38 is provided to move the dome between a first, open, retracted position away from the platen 33, and a second, closed, sealed position abutting against the platen 33 thereby defining the pressure chamber 35. In the retracted position, the dome is located sufficiently far from the platen 33 to provide adequate clearance for manual or automatic placement of the open bag 32 on the platen. In one embodiment, the product 31 is located within the open bag prior to placement on the platen. Instead, however, the product 31 may be placed in the open bag 32 after the bag 32 has been situated on the support surface 37 of platen 33.

In one embodiment, the actuator 38 is a double-acting pneumatic cylinder operably coupled to a pressure source, for example, a pressurized air supply hose 39 of a compressed air source 40. A linear-slide support mechanism 41 moveably supports the pressure dome 34 relative to the base 36. This configuration is low maintenance, simple, and can be operated at relatively high speeds. One will appreciate that the actuator 38 and its supporting structure may include other suitable means for moving the pressure dome between its open and closed positions. For example, the actuator 38 may utilize any suitable structure to mechanically open and close the packaging system 30 by moving the platen 33 and the pressure dome 34, or other alternative arrangement relative to one another.

In one embodiment, the pressure dome 34 includes a pressure seal 42 mounted along a lower edge thereof to provide a substantially airtight seal when the pressure dome 34 abuts against the platen 33. For example, the sides and bottom edges of the pressure dome 34 may include a pressure seal (e.g., rubber seal 42), to prevent pressure loss during operation. A pressure-chamber valve 43 and an actuator valve 44 are operably connected to an electrical control module 45. A pressurized air supply hose 39 is connected to the "IN" port of an actuator pressure regulator 46 and also to an "IN" port of a pressure-chamber pressure regulator 47. An "OUT" port of actuator pressure regulator 46 is connected to a "P" port of actuator valve 44. The "OUT" port of the pressure-chamber pressure regulator is connected to the "P" port of pressure-chamber valve 43. Port "A" of actuator 38 is connected to port "A" of actuator valve 44 while port "B" of actuator 38 is connected to port "B" of actuator valve 44. Port "A" of pressure-chamber valve 43 is fluidly connected to pressure chamber 35 through a pressure-chamber port 48.

Figure 2:
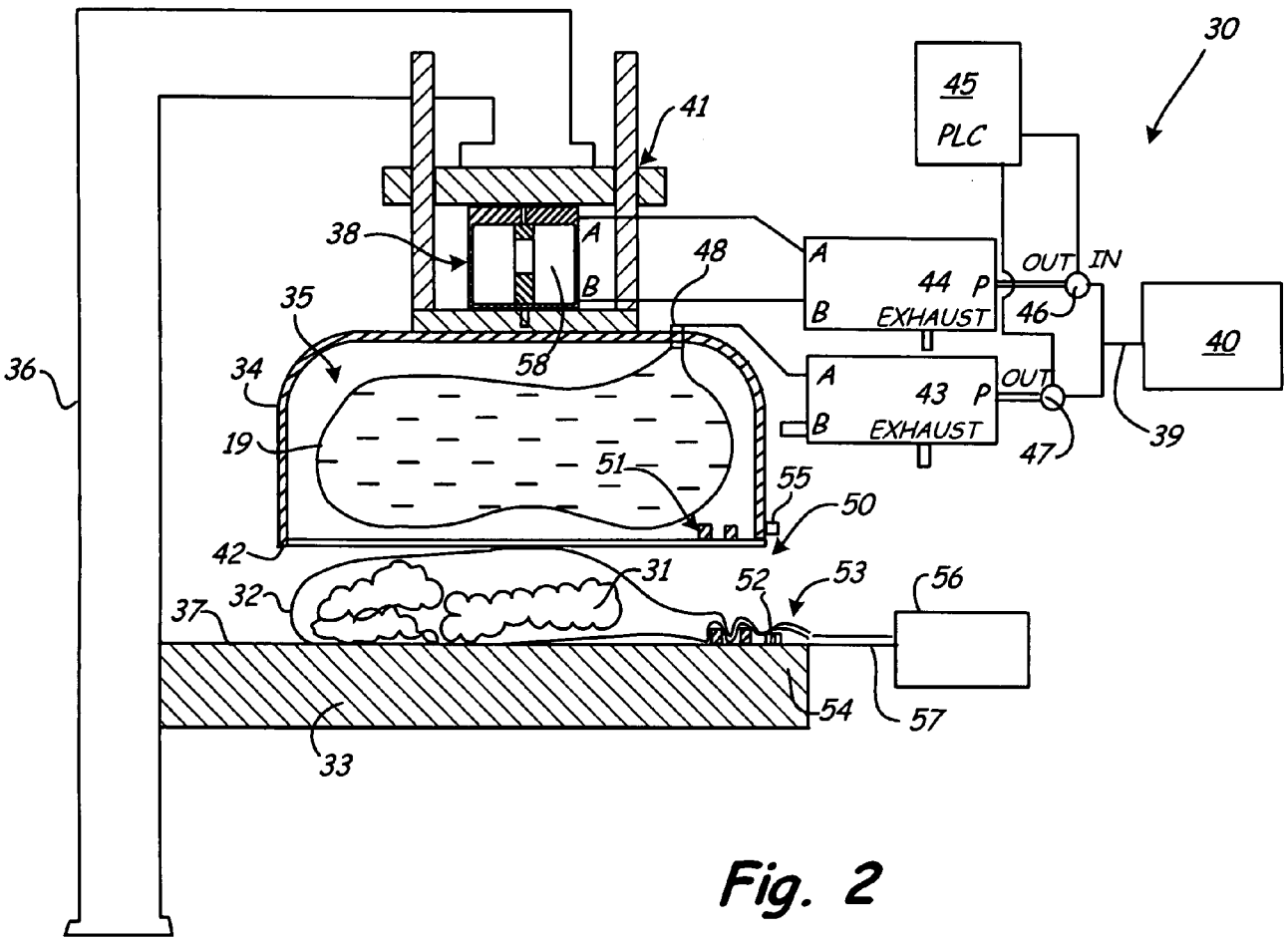
FIG. 2 is a schematic illustration of the packaging and sealing system FIG. 1 incorporating an optional bladder and an optional flush gas system.

In general, the pressure dome 34 functions to substantially enclose the open bag 32, and the product 31 contained therein, and to facilitate a rise in pressure within the pressure chamber 35. This rise in pressure compresses the walls of the open bag around the product 31, which may also lead to some compression of the product 31. In one embodiment, air is supplied to the pressure chamber 35 to effect the pressure increase. Other suitable gases may be used to increase the internal pressure inside of the pressure chamber 35. Alternatively, a liquid may be used to compress the bag 32 and product 31 to an elevated pressure or to apply a temperature controlled compression to the product 31. In such an embodiment, liquid would be used to fill one or more bladders (see, e.g., bladder 49 in FIG. 2) inside the pressure dome (or inside a pair of half domes of a clamshell pressure-dome packaging-press configuration). Alternatively, the entire operation may be performed with the components submerged in a chilled or heated liquid. This allows for high pressures but eliminates the need for using a hydraulic bladder, which in turn allows for much faster operation as there would be no bladder to empty before the next cycle.

As noted above, the platen 33 has a flat surface to receive and support the open package 32 and the product 31 to be sealed therein. Alternatively, various configurations specific to particular products could be used. In the embodiment of FIG. 1, platen 33 has a substantially horizontal orientation that is particularly suited for horizontal packaging applications. In vertical packaging operations, the platen 33 may be replaced by a second pressure dome that is deployed against the pressure dome 34 as a clamshell. Both domes would move in opposing directions to one another with the product 31 located in the center between the two opposing domes.

A seal assembly 50 is provided that is configured to straiten, that is, substantially pinch the open end of bag 32 so as to substantially constrict the open end of the bag 32 when the pressure dome 34 is in the closed position. Unlike prior devices, the seal assembly 50 is devoid of any air vents or open passageways providing a linear path out from the interior of the bag 32 when the pressure dome 34 abuts against the platen 33. Such prior air vents disadvantageously allow the free flow of air, along with other materials, through the open end of bag. The seal assembly 50 compresses the open end of bag 32 so as to restrict the free flow of particulate and relatively thick liquids from the interior of the bag 32. The configuration of the seal assembly 50, however, allows gas under elevated pressure to pass through the open end of the bag 32 past the seal assembly 50, thus allowing expulsion of gas from within the open bag 32 as the bag is compressed within the pressure chamber 35.

In one embodiment, the seal assembly is a labyrinth assembly 50 adapted for corrugating the open end of bag 32, that is, for forming one or more folds in the open end of the bag as the pressure dome 34 is closed against the platen 33. As shown in FIG. 1, a first labyrinth structure 51 is provided on the pressure dome 34 that is received in an overlapping fashion by a second labyrinth structure 52 provided on the platen 33 as the pressure dome 34 moves into its closed position.

In one embodiment, each labyrinth seal structure 51, 52 includes two strips of overlapping metal baffles that corrugate the open end of the bag 32 into a series of folds that allow gases and relatively thin liquids to pass relatively freely from one side of the seal assembly 50 to the other (e.g., from the interior portion of the open bag 32 located within the pressure dome 34, through the open end of the bag 32, and outside the pressure dome 34) at low velocities, but tend to restrict the flow of particulate and thick liquids due to the directional changes imparted by the flow path through the corrugations effected by the seal assembly 50. In some embodiments, the labyrinth assembly 50 may be eliminated if the product being packaged has a zero flow characteristic under compression, for example, if the product is a solid mass. The labyrinth seal is particularly useful for packaging fresh meat products, which typically include purge including both a liquid and smaller meat particles.

The packaging system is also provided with a sealing device 53 to close the open package 32. In the illustrated embodiment, the sealing device includes a first sealing component 54 provided on an edge of the platen 33 and a corresponding second sealing component 55 on the pressure dome 34. The first sealing component may be an electric heating element such as a spring loaded hot-melt strip-seal bar. In one embodiment, the electric heating element is capable of rapidly reaching plastic melting temperatures. In one embodiment, the heating element is covered with either a non-stick coating such as TEFLON or has a non-stick strip such as TEFLON heat tape covering the contact area of the heating element. In one embodiment, the second sealing component is a non-stick strip (e.g., a TEFLON strip), but one will appreciate that the second sealing component may also include a heating element. The heat-sealing components are aligned to substantially abut one another when the pressure dome is in the closed position.

Any heated strip assembly or heat applying process capable of melting two or more sheets of plastic webbing or other suitable packaging material into one another to form a hermetic seal may be utilized. In order to cool the heating element between applications, an air blow-off or any other suitable cooling technique may be utilized in combination with the sealing device.

In one embodiment, the open bag 32 or other suitable open package, with or without the product 31 therein, is manually or automatically placed on the platen 33 such that the open end of the bag extends across a seal zone of the platen, namely, across the first sealing component 54. In the event that the product 31 is not already located in the bag 32, the product 31 may be placed into the open bag 32 situated on the platen 33 in a conventional manner. Alternatively, the open package 32 may be formed from a continuously fed roll of webbing, which may be sealed on one side to form a packaging tube, or from a continuously fed packaging tube, or both. When the webbing is automatically fed in tube form, the sealing device may include a double hot-melt seal strip bar with a cutting blade located between two heat elements may be used in a known manner so that the top seal of a preceding sealed bag becomes the bottom seal of a subsequent sealed bag, or vice versa. The cutting blade cuts the webbing between the two seals thereby separating a newly formed sealed bag from the continuously fed tube of webbing and/or a yet-to-be-sealed subsequent bag.

The packaging system 30 of the present invention may incorporate an atmospheric gas flush system 56 for the open bags having a gas inlet 57. One will appreciate that it is sometimes desirable to introduce various gases into the package and/or on the product to be sealed within the package in order to extend post-packaging shelf life or modify product color in some products. For example, various flush gases including, but not limited to, argon (Ar), carbon dioxide ($CO_2$), carbon monoxide (CO), and/or other suitable gases may be used to pre-flush the bag to further eliminate or displace oxygen. Alternatively, the bag could be press-evacuated to eliminate the free air or oxygen within the package prior to filling with the gas, then adding the desired gas and sealing. Such pre-evacuation would offer significant volumetric savings in gas costs as the gas would not be diluted by free air within the bag and therefore require less gas per bag. One exemplary use would be to place multiple, foam-tray, over-wrapped products into a larger bag, package or container and flushing the interior thereof with the flush gas to extend the shelf life of the products. Alternatively, steam may be used inside the chamber as the positive pressure source and as a pasteurizing agent for a perishable product. If used with heat shrinkable webbing or bags, this process would further assist in the expulsion of atmosphere inside the bag.

In use, the product 31 is placed upon the platen 33 within the open bag 32 or other suitable package. The open end of the bag is laid flat across the seal assembly 50 and the sealing device 53 so that a portion of the bag 32 protrudes past the labyrinth seal assembly 50 and the beyond the hot melt seal bars 54, 55. The operation cycle start initiates a signal from the electrical control module 45 that is sent to the actuator valve 44 that is then activated thus allowing pressurized air to flow from the air supply hose to the "A" port of double-acting air cylinder 38. Activation of actuator valve 44 also opens the "B" port of the air cylinder to ambient pressure, allowing a piston 58 inside the air cylinder to move downward, Thus pressure dome 34 moves toward the platen 33 thereby surrounding and substantially enclosing the bag 32 and the product 31.

With the pressure dome 34 in its closed position, the pressure dome 34 and the platen 33 form the pressure chamber 35 about the open bag and the product. The open end of the bag 32 is woven back and forth through the seal assembly 50 and is also trapped between the spring-loaded, hot-melt seal bar 54 and the strip 55 on the edge of the pressure dome 34. After the pressure dome 34 is closed, the electrical control module sends a signal to the pressure-chamber valve 43 that causes air to flow out of its "A" port and into the pressure chamber 35 through one or more pressure-chamber ports 48. Incoming air through the pressure chamber ports 48 pressurizes the volume within the pressure chamber 35 and applies direct pressure to the outside of the bag 32, which contains both the product 31 and any residual air or atmosphere trapped inside the bag 32. The force of the applied pressure on the outside of the bag 32 compresses the open bag 32 against the product 31. As the open end of the bag 32 is restricted but nonetheless fluidly coupled to ambient or atmospheric pressure through seal assembly 50, the applied pressure compressing the bag 32 effects expulsion of residual atmosphere or air trapped inside the bag 32. Due to the nature of compressed gases, the residual atmosphere of air is quickly squeezed out from the inside of the bag 32 and expelled through the seal assembly 50 into the ambient environment.

After a short dwell time to allow optimum pressurization and air expulsion, the electrical control module 45 sends a current through the heating element of the strip-seal bar 54 for a pre-determined length of time. The strip-seal bar 54 heats up to a predetermined temperature and hermetically seals the open end of the bag 32. Next, the "A" ports of actuator and pressure-chamber valves 44, 43 are opened to ambient or room pressure. Port "B" of the actuator valve 44 is pressurized thereby moving the piston 58 upwardly to move the pressure dome 34 to its open position away from the platen 33, thus allowing removal of the packaged product 31, that is, a newly sealed bag containing the product 31.

Although the present invention has been described with reference to preferred embodiments, persons skilled in the art will recognize that changes may be made in form and detail without departing from the spirit and scope of the invention.

I claim:

1. A positive-pressure packaging system comprising:

a platen for receiving a product and a packaging material having an open end;

a dome moveable to a first position relative to the platen wherein the product may be placed on the platen, and a second position relative to the platen wherein the product is substantially enclosed inside of a pressure chamber defined by the platen and the dome;

a seal assembly for operatively coupling the dome to the platen in the second position and for straightening the open end of the packaging material, wherein the seal assembly is structured to allow expulsion of fluids within the packaging material from the pressure chamber through the seal assembly; and a pressure source operably coupled with the dome for increasing pressure within the dome relative to the ambient pressure so that the packaging material is compressed against the product.

2. The system of claim 1 further comprising a sealing device on at least one of the platen and the dome configured to seal the packaging material after the packaging material has been compressed.

3. The system of claim 2 wherein the sealing device includes a heating element configured to provide the package with a hermetic seal.

4. The system of claim 2 further comprising a gas inlet for injecting a gas into the packaging material to purge an interior of the packaging material before compressing the packaging material.

5. The system of claim 4 wherein the gas is selected from the group consisting of Ar, $C0_2$, or CO.

6. The system of claim 1 wherein the pressure source includes an air compressor operably coupled with the dome to provided pressurized air to the pressure chamber.

7. The system of claim 1 wherein the pressure source includes an expandable bladder configured to expand and exert pressure against the packaging material.

8. The system of claim 1 wherein the seal assembly is a labyrinth structure that allows passage of fluids and obstructs passage of particulates.

9. The packager of claim 1 wherein the packaging material includes multiple layers of a webbing.

10. A positive-pressure packaging system comprising:

a platen having a substantially flat surface;

a pressure dome moveable between a first open position relative to the platen wherein the flat surface is exposed to ambient pressure, and a second closed position relative to the platen substantially sealing the dome against the platen to form a pressure chamber;

a seal assembly for corrugating an open end of a package located on the flat surface as the dome moves to the second closed position;

a pressure source operably coupled with the dome for increasing pressure within the pressure chamber relative to the ambient pressure so that the open package is compressed against the product, wherein the seal assembly allows expulsion of fluids from the package through the open end thereof and inhibits expulsion of a particulate; and a sealing device on at least one of the platen and the dome configured to seal the package after the package has been compressed.

11. The system of claim 10 wherein the seal assembly includes a first labyrinth structure provided on the flat surface of the platen, and a second labyrinth structure provided on the pressure dome, the first and second labyrinth structures being engageable so as to form a closed seal that allows the passage of fluids under increased pressure.

12. The system of claim 11 wherein the sealing device includes a first heat-sealing component on the platen, and a second heat-sealing component on the pressure dome and positioned to substantially abut against the first heat-sealing component when the pressure dome is in the closed position.

* * * * *